United States Patent [19]

Emoto et al.

[11] Patent Number: 4,527,717

[45] Date of Patent: Jul. 9, 1985

[54] APPARATUS FOR QUANTITATIVELY SUPPLYING LIQUID

[75] Inventors: Takao Emoto, Kitakami; Yoshitaka Nagata, Kawasaki, both of Japan

[73] Assignee: Tokyo Shibaura Denki Kabushiki Kaisha, Kawasaki, Japan

[21] Appl. No.: 421,886

[22] Filed: Sep. 23, 1982

[30] Foreign Application Priority Data

Oct. 15, 1981 [JP] Japan ..... 56-163420

[51] Int. Cl.[3] ..... B22D 35/06; B67D 5/62

[52] U.S. Cl. ..... 222/593; 222/602; 222/603; 222/450; 222/510; 222/146.5

[58] Field of Search ..... 222/146 HE, 377, 378, 222/385, 386, 510, 424.5, 425, 450, 591, 593, 594, 602, 603

[56] References Cited

U.S. PATENT DOCUMENTS

| | | | |
|---|---|---|---|
| 1,595,822 | 4/1924 | DuCharme | 222/450 X |
| 2,564,427 | 8/1951 | De Rugeris | 222/510 X |
| 2,698,015 | 12/1954 | Brown | 222/425 X |
| 2,912,143 | 11/1959 | Woolfolk | 222/146 HE X |
| 3,952,921 | 4/1976 | Tanner | 222/146 HE |

*Primary Examiner*—H. Grant Skaggs
*Attorney, Agent, or Firm*—Finnegan, Henderson, Farabow, Garrett & Dunner

[57] ABSTRACT

In an apparatus for quantitatively supplying melted solder, a first chamber storing the melted solder is provided with a vessel of the apparatus. A second chamber communicates with the first chamber through a first communicating hole, and communicates with a third chamber through a second communicating hole. A nozzle for supplying the melted solder is disposed at the third chamber. A valve for opening and closing the first communicating hole is disposed therein. A piston is disposed in the second communicating hole. The melted solder stored in the first chamber is moved to the second chamber when the valve is opened. Subsequently, the valve is closed, and the piston which was disposed so as not to move the melted solder from the second chamber to the third chamber, is moved toward the second chamber, thus allowing the melted solder to move from the second chamber to the third chamber. When the piston is moved back toward the third chamber, the melted solder is supplied from the nozzle. Therefore, the melted solder is quantitatively supplied regardless of the amount remaining in the vessel.

19 Claims, 1 Drawing Figure

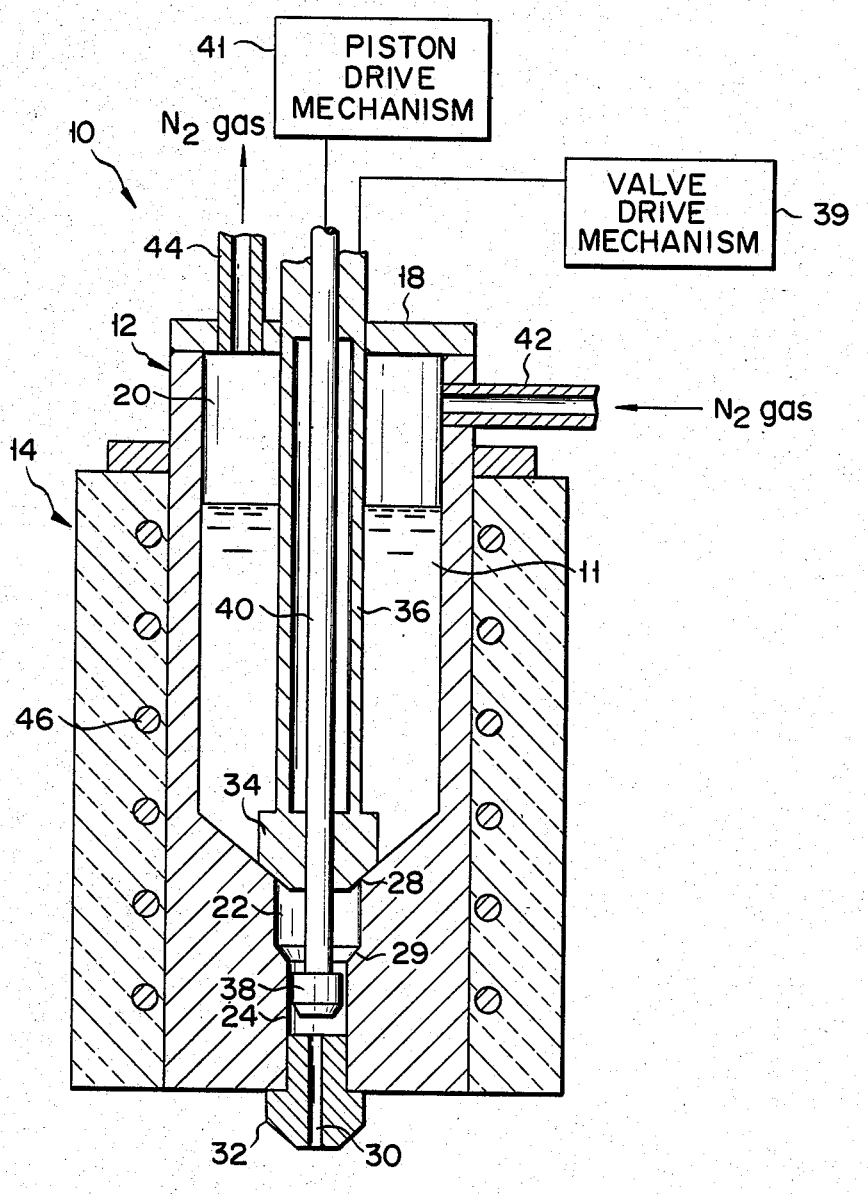
41
PISTON DRIVE MECHANISM
$N_2$ gas
10
VALVE DRIVE MECHANISM
39
44
18
12
42
20
$N_2$ gas
14
11
40
36
46
34
28
22
29
38
24
32
30

APPARATUS FOR QUANTITATIVELY SUPPLYING LIQUID

BACKGROUND OF THE INVENTION

The present invention relates to an apparatus for quantitatively supplying a liquid and, more particularly, to an apparatus for quantitatively supplying a liquid which has a relatively high viscosity and a high specific gravity.

Generally, in the process for manufacturing semiconductor elements, solder is used to join metal pieces. In soldering, a predetermined amount of melted solder must be supplied to join the metal pieces. In response to the needs described above, an apparatus for quantitatively supplying solder is used in the process for manufacturing semiconductor elements.

In a conventional apparatus, melted solder is stored in a chamber of the apparatus. When a valve disposed in the chamber is opened, the melted solder is supplied from a nozzle disposed at the end of the chamber due to the pressure acting on the solder and its dead weight.

In the conventional apparatus of this type, when the valve is opened, the dead weight of the melted solder stored at the lower portion of the chamber varies in accordance with the amount of melted solder remaining in the chamber. When the level of the melted solder remaining in the chamber is lowered, its dead weight decreases. As a result, the amount of melted solder to be supplied may become below a predetermined value. However, if an excessive amount of melted solder is kept in the chamber, the dead weight of the solder increase. As a result, the amount of melted solder to be supplied is above the predetermined value. Thus, the melted solder cannot be accurately supplied.

SUMMARY OF THE INVENTION

It is, therefore, an object of the present invention to provide an apparatus for quantitatively supplying a liquid with high precision.

According to an aspect of the present invention, there is provided an apparatus for quantitatively supplying a liquid, comprising:

a vessel receiving a liquid and having first, second and third chambers, and first and second communicating holes, said first and second chambers being communicated through said first communicating hole, and said second and third chambers being communicated through said second communicating hole;

a nozzle communicating with said third chamber to define a supply channel for the liquid;

means for selectively opening and closing said first communicating hole, said opening/closing means being settable in a first position to close said first communicating hole and in a second position to open said first communicating hole so as to communicate said first chamber with said second chamber; and supplying means for restraining supply of the liquid from said second chamber to said third chamber through said second communicating hole when said opening/closing means is set in the second position, and for supplying a predetermined amount of the liquid stored in said third chamber through said nozzle by applying pressure thereto when said opening/closing means is set in the first position.

BRIEF DESCRIPTION OF THE DRAWING

The accompanying drawing is a cross-sectional view of an apparatus for quantitatively supplying a liquid according to an embodiment of the present invention.

DETAILED DESCRIPTION OF THE PREFERRED EMBODIMENT

The figure shows an apparatus 10 for supplying a liquid which has a high viscosity and a high specific gravity, such as a solder which has a specific gravity of 11.0 to 11.6, according to an embodiment of the present invention. The apparatus 10 is provided with a hollow cylindrical vessel 12 of a heat conductive material such as stainless steel. First, second and third chambers 20, 22 and 24 of a substantially cylindrical shape are formed along the longitudinal axis of the vessel 12. The first chamber 20 communicates with the second chamber 22 through a first communicating hole 28. The inner diameter of the first chamber 20 is larger than that of the second chamber 22. The second chamber 22 communicates with the third chamber 24 through a second communicating hole 29. The inner diameter of the second chamber 22 is larger than the of the third chamber 24. A cover 18 is detachably and hermetically mounted on one opening of the vessel 12. An inlet pipe 42 and an outlet pipe 44 are respectively connected to the side wall of the vessel 12 and the cover 18. Nitrogen gas is supplied to the first chamber 20 through the inlet pipe 42, and is exhausted through the outlet pipe 44. A nozzle 32 which has a bore 30 of an inner diameter of 0.19 to 0.25 mm is mounted at the other opening of the vessel 12. A hollow rod 36 is hermetically and slidably mounted on the cover 18. The hollow rod 36 extends into the first chamber 20. A valve 34 for closing the first communicating hole 28 is disposed at the distal end of the hollow rod 36. A rod 40 is slidably mounted inside the hollow rod 36 and the valve 34. The rod 40 extends into the third chamber 24 through the second chamber 22. A piston 38 whose outer diameter is smaller than the inner diameter of the third chamber 24 is mounted at the distal end of the rod 40. The hollow rod 36 and the rod 40 are respectively coupled to a valve drive mechanism 39 and a piston drive mechanism 41. The hollow rod 36 is driven by the valve drive mechanism 39 so that the valve 34 is periodically moved into a closing position to close the first communicating hole 28, and is moved into an opening position to open the first communicating hole 28. When the valve 34 is kept in the closed position, the rod 40 is driven by the piston drive mechanism 41 so that the piston 38 is moved from the interior of the third chamber 24 to that of the second chamber 22. The piston 38 is then kept in the third chamber 24 while the valve is kept in the opened position.

A heater unit 14 is made of a heat insulating material. The heater unit 14 which has a heater 46 is mounted on the outer surface of the vessel 12.

The operation of the apparatus for quantitatively supplying a liquid according to an embodiment of the present invention will be described.

Melted solder 11 stored in the vessel 12 is kept at a predetermined temperature of 300° to 500° C. Thus, the solder is kept melted. The melted solder 11 can not oxidize due to the presence of $N_2$ gas at substantially ambient pressure which is supplied from the inlet pipe 42 to the first chamber 20.

When the valve 34 is moved into the opening position by the valve drive mechanism 39, that is, when the valve 34 is moved against the force of gravity, the first communicating hole 28 is opened. When the first chamber 20 then communicates with the second chamber 22, the melted solder 11 remaining in the first chamber 20 is moved into the second chamber 22 by the dead weight of the melted solder 11. When the melted solder 11 is introduced into the second chamber 22, the valve 34 is moved in the direction of gravity to be set in the closed position by the valve drive mechanism 39 through the hollow rod 36. The first communicating hole 28 is then closed, and the first chamber 20 stops communicating with the second chamber 22. Subsequently, the piston 38, having an outside diameter smaller than the inner diameter of the third chamber, is moved away from the nozzle into the lower portion of the second chamber 22 by means of the piston drive mechanism 41. Upon this upward movement of the piston 38, the melted solder 11 is introduced from the second chamber 22 into the third chamber 24.

The piston 38 is then moved downward toward the nozzle by the piston drive mechanism 41. The melted solder 11 is discharged from the bore 30 of the nozzle 32 by the urging force of the piston 38 and by its own-weight. In the process for manufacturing semiconductor devices, for example, the melted solder 11 is discharged in this manner from the nozzle 32 every 12 seconds.

The present invention is not limited to the above embodiment. Various changes and modifications may be made within the spirit and scope of the present invention.

A member such as a disc-shaped member for pressing the melted solder downward by its vertical movement may be used in place of the piston.

What we claim is:

1. An apparatus for quantitatively supplying a viscous liquid comprising:

a vessel for containing the viscous liquid, said vessel having first, second and third chambers and first and second communicating holes, said first and second chambers communicating with each other through said first communicating hole and said second and third chambers communicating with each other through said second communicating hole;

a nozzle communicating with said third chamber for supplying quantitative amounts of the viscous liquid from said vessel;

means for selectively opening and closing said first communicating hole, said opening and closing means being selectively movable to a closed position which closes said first communicating hole and prevents the flow of viscous liquid from said first chamber to said second chamber and to an open position which opens said first communicating hole to allow the flow of viscous liquid from said first chamber to said second chamber; and control means for restraining the flow of viscous liquid from said second chamber to said third chamber when said opening and closing means is in said open position, for supplying a predetermined amount of viscous liquid from said second chamber to said third chamber, when said opening and closing means is in said closed position, and for supplying a predetermined amount of viscous liquid from said third chamber through said nozzle.

2. The apparatus of claim 1 wherein said control means is positioned within said second and third chambers.

3. The apparatus of claim 2 wherein said viscous liquid is solder.

4. The apparatus of claim 1 wherein said control means includes a piston slidable within the second and third chambers, the piston having an outer perimeter which is smaller than the outer perimeter of the third chamber so that, when the piston moves away from said nozzle and the opening and closing means is in the closed position, a predetermined amount of viscous liquid flows around the piston and into the third chamber and, when the piston then moves toward said nozzle, a predetermined amount of viscous liquid flows through said nozzle.

5. The apparatus of claim 4 further comprising a piston drive mechanism for selectively moving said piston toward and away from said nozzle.

6. The apparatus of claim 4 wherein said opening and closing means includes a valve which closes said first communicating hole when said valve is moved into engagement with said first communicating hole.

7. The apparatus of claim 6 further comprising a valve drive mechanism for moving said valve toward and away from said first communicating hole.

8. The apparatus of claim 7 wherein said first, second and third chambers are disposed along a longitudinal axis of said vessel.

9. The apparatus of claim 8 wherein the longitudinal axis is vertical and said second chamber is positioned below said first chamber and said third chamber is positioned below said second chamber.

10. The apparatus of claim 9 further comprising heater means for keeping said vessel at a predetermined temperature.

11. The apparatus of claim 10 wherein said vessel is made of stainless steel.

12. The apparatus of claim 9 wherein said viscous liquid has a specific gravity of 11.0 to 11.6.

13. The apparatus of claim 9 wherein said viscous liquid is solder.

14. The apparatus of claim 9 wherein said nozzle has an inner diameter within the range of 0.19 to 0.25 mm.

15. The apparatus of claim 9 wherein said first and second chambers are cylindrical in shape and the inner diameter of said first chamber is greater than the inner diameter of said second chamber.

16. The apparatus of claim 9 further comprising a cover for said vessel and means for supplying a nonoxidizing gas to said vessel.

17. The apparatus of claim 6 wherein said opening and closing means includes a hollow rod, and said valve is positioned at the end of said hollow rod.

18. The apparatus of claim 17 wherein said piston is fixed to a second rod, and said second rod is slidably mounted within said hollow rod.

19. The apparatus of claim 4 wherein said second and third chambers are cylindrical in shape and the inner diameter of said second chamber is greater than the inner diameter of said third chamber.

* * * * *